US007101272B2

(12) United States Patent
Chen et al.

(10) Patent No.: US 7,101,272 B2
(45) Date of Patent: Sep. 5, 2006

(54) CARRIER HEAD FOR THERMAL DRIFT COMPENSATION

(75) Inventors: Hung Chih Chen, Santa Clara, CA (US); Steven M. Zuniga, Soquel, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 11/037,919

(22) Filed: Jan. 15, 2005

(65) Prior Publication Data

US 2006/0160479 A1 Jul. 20, 2006

(51) Int. Cl.
*B24B 1/00* (2006.01)

(52) U.S. Cl. ..... 451/287; 451/285; 451/290; 438/692

(58) Field of Classification Search ..... 451/285–290, 451/397–399; 156/345; 216/88; 438/692–693
See application file for complete search history.

(56) References Cited

U.S. PATENT DOCUMENTS 5,205,082 A 4/1993 Shendon et al.
5,423,716 A 6/1995 Strasbaugh
5,449,316 A 9/1995 Strasbaugh
5,584,751 A 12/1996 Kobayashi et al.
5,624,299 A 4/1997 Shendon
5,643,053 A 7/1997 Shendon
5,643,061 A 7/1997 Jackson et al.
5,645,474 A 7/1997 Kubo et al.
5,681,215 A 10/1997 Sherwood et al.
5,695,392 A 12/1997 Kim
5,759,918 A 6/1998 Hoshizaki et al.
5,803,799 A 9/1998 Volodarsky et al.
5,851,140 A 12/1998 Barns et al.
5,879,220 A 3/1999 Hasegawa et al.
5,957,751 A 9/1999 Govzman et al.
5,964,653 A 10/1999 Perlov et al.
5,993,302 A 11/1999 Chen et al.
6,068,548 A 5/2000 Vote et al.
6,077,151 A 6/2000 Black et al.
6,110,025 A 8/2000 Williams et al.
6,183,354 B1 2/2001 Zuniga et al.
6,196,905 B1 3/2001 Inaba
6,251,215 B1 6/2001 Zuniga et al.
6,354,928 B1 3/2002 Crevasse et al.
6,390,904 B1 * 5/2002 Gleason et al. ..... 451/286
6,422,927 B1 7/2002 Zuniga
6,558,232 B1 5/2003 Kajiwara et al.
6,565,424 B1 5/2003 Katagiri et al.
6,579,151 B1 6/2003 Tseng et al.
6,585,850 B1 * 7/2003 Kenji et al. ..... 156/345.12
6,602,116 B1 8/2003 Prince
6,666,756 B1 12/2003 Travis
6,705,923 B1 * 3/2004 Liu et al. ..... 451/7
6,716,094 B1 4/2004 Shendon et al.

* cited by examiner

*Primary Examiner*—Lee D. Wilson
*Assistant Examiner*—Anthony Ojini
(74) *Attorney, Agent, or Firm*—Fish & Richardson

(57) ABSTRACT

Systems and apparatus providing a carrier head for chemical mechanical polishing are described. The carrier head includes a base, a support structure attached to the base, a retaining structure attached to the base, and a connector attached to the base and the retaining structure. The support structure includes a receiving surface for contacting a substrate. The retaining structure prevents the substrate from moving along the receiving surface. The base and the retaining structure can thermally expand at different rates of expansion without causing distortion to one another.

37 Claims, 5 Drawing Sheets

CARRIER HEAD FOR THERMAL DRIFT COMPENSATION

TECHNICAL FIELD

This invention relates to a carrier head for chemical mechanical polishing.

BACKGROUND

An integrated circuit is typically formed on a substrate by the sequential deposition of conductive, semiconductive or insulative layers on a silicon substrate. One fabrication step involves depositing a filler layer over a non-planar surface, and planarizing the filler layer until the non-planar surface is exposed. For example, a conductive filler layer can be deposited on a patterned insulative layer to fill trenches or holes formed in the insulative layer. The filler layer is then planarized until the raised pattern of the insulative layer is exposed. After planarization, the portions of the conductive layer remaining between the raised pattern of the insulative layer form vias, plugs and lines that provide conductive paths between thin film circuits on the substrate.

Planarization can also be used to provide a planar layer surface for photolithography. For example, an etching step used in manufacturing integrated circuits can include depositing a photo-resist layer on an exposed surface of the substrate, and then selectively removing portions of the resist layer by a photolithographic process to provide the etch pattern on the layer. If the layer is non-planar, then photolithographic techniques of patterning the resist layer may not be suitable because the surface of the substrate may be sufficiently non-planar to prevent focusing of the photographic apparatus on the entire layer surface. The substrate surface may therefore need to be periodically planarized to restore a planar layer surface of the photolithography.

Chemical mechanical polishing (CMP) is one accepted method of planarization. This planarization method typically requires that the substrate be mounted on a carrier or polishing head of a CMP apparatus. The exposed surface of the substrate is placed against a rotating polishing disk pad or belt pad. The polishing pad can be either a "standard" pad or a fixed-abrasive pad. A standard pad has a durable roughened surface, whereas a fixed-abrasive pad has abrasive particles held in a containment media. A polishing slurry, including at least one chemically-reactive agent, and abrasive particles if a standard pad is used, is supplied to the surface of the polishing pad.

SUMMARY

Systems and apparatus providing a carrier head for chemical mechanical polishing are described. In general, in one aspect, the invention features a carrier head for chemical mechanical polishing. The carrier head includes a base, a support structure attached to the base, a retaining structure attached to the base and a connector attached to the base and the retaining structure. The support structure has a receiving surface for contacting a substrate. The retaining structure prevents the substrate from moving along the receiving surface. The connector allows relative lateral movement between the base and the retaining structure.

In general, in another aspect, the invention features a chemical mechanical polishing apparatus. The apparatus includes a polishing pad to polish a substrate, and a carrier head to press the substrate against the polishing pad. The carrier head includes a base, a support structure attached to the base having a receiving surface for contacting a substrate, a retaining structure attached to the base to prevent the substrate from moving along the receiving surface, and a connector attached to the base and the retaining structure. The connector allows relative lateral movement between the base and the retaining structure.

In general, in another aspect, the invention features a carrier head for chemical mechanical polishing. The carrier head includes a base, a support structure attached to the base, a retaining structure attached to the base, and a connector attached to the base and the retaining structure. The support structure includes a receiving surface for contacting a substrate. The retaining structure prevents the substrate from moving along the receiving surface. The base and the retaining structure can thermally expand at different rates of expansion without causing distortion to one another, e.g., without the retaining structure flexing.

Embodiments of the carrier head can include one or more of the following features. The connector can include a component, or alternatively a plurality of components, adapted to flex in a lateral direction and allow lateral movement between the base and the retaining structure. The component or components can be thin-walled annular components and may be formed from a flexible material. If the base has a substantially circular cross-section and the retaining structure is substantially annular, the connector can include a thin-walled annular component affixed to the base, and a horizontal annular component affixed to an upper surface of the retaining structure. The thin-walled annular component is joined to the horizontal annular component and is movable relative to the horizontal annular component. The thin-walled annular component may be flexible. In one embodiment, the thin-walled annular component can be hingedly affixed to the circumferential edge of the base and to the horizontal annular component.

The connector can include a housing within the base and two or more rigid members. Each rigid member has an upper portion housed in the housing and a lower portion secured in an aperture formed in the retaining structure, where the rigid member is laterally movable within the housing. Each rigid member can be a threaded nut and secured in the aperture by threading the rigid member into aperture.

The retaining structure and the receiving surface can define a cavity for receiving the substrate. The relative lateral movement of the base and retaining structure can be from at least one of expansion or contraction of one or both of the base and the retaining structure.

Implementations of the invention can realize one or more of the following advantages. A connector is included in a carrier head that allows a base to thermally expand independent of a retaining structure. The retaining structure is not urged away from a polishing surface and/or warped by thermal expansion of the base, and the retaining structure can remain flat against the polishing surface. A uniform force therefore can be exerted by the carrier head against the substrate, providing a uniform polishing profile across the substrate. Additionally, in a polishing operation of multiple substrates, starting with an idle (i.e., cool) carrier head, a uniform removal rate can be applied to the multiple substrates.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

A carrier head provides a controllable load on the substrate to push the substrate against the polishing surface. Thermal expansion of the carrier head during a polishing operation is typical. Different components of a carrier head may be made from materials with differing rates of thermal expansion. Additionally, different regions of the carrier head may heat up at different rates, also resulting in differing rates of thermal expansion. The differing rates of thermal expansion through out the carrier head can lead to warping of the carrier head, having an adverse effect on the polishing profile of each substrate, and the polishing uniformity of a series of substrates.

Figure 1A:
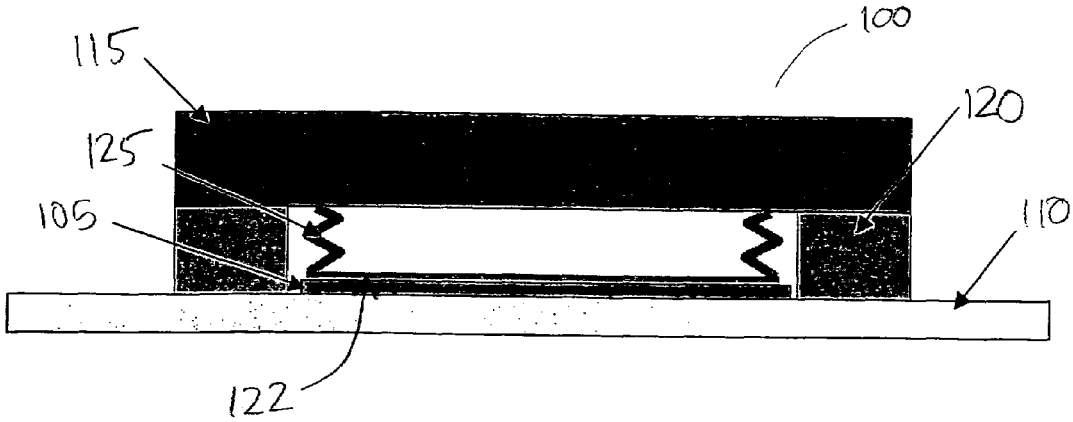
FIG. 1A (Prior Art)
FIG. 1A is a schematic representation of a prior art carrier head.

FIG. 1A shows a schematic representation of a conventional carrier head 100 exerting a force on a substrate 105 against a polishing surface 110. The carrier head 100 includes a base 115 and a retaining structure 120. A support structure 125 is attached to the base 115 and includes a receiving surface 122 for contacting the substrate 105. The retaining structure 120 and the receiving surface 122 define a cavity for receiving the substrate 105, while the retaining structure 120 prevents the substrate 105 from moving along the receiving surface 122.

During a polishing operation, the carrier head 100 may rotate or translate in relation to the polishing surface 110, which polishing surface 110 may also rotate or translate in relation to the carrier head 100. The relative motion of the carrier head 100 and the polishing surface 110 causes the substrate 105 to move across the surface of the polishing surface 110, and typically in combination with a polishing slurry, the surface of the substrate 105 in contact with the polishing surface 110 is planarized.

Figure 1B:
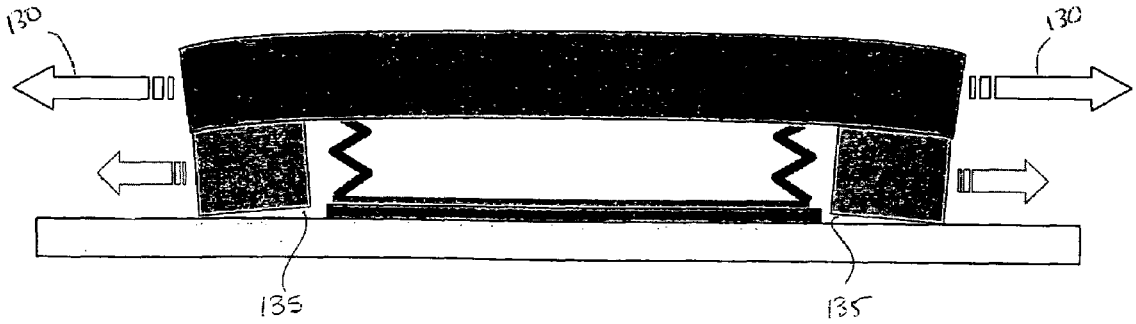
FIG 1B (Prior Art)
FIG. 1B is a schematic representation of the carrier head of FIG. 1A having undergone thermal expansion.

FIG. 1B shows a schematic representation of the carrier head 100 of FIG. 1A influenced by the effects of thermal expansion resulting from a polishing operation. The effects of thermal expansion are exaggerated for illustrative purposes. The base 115 is typically made from a different material than the retaining structure 120, which materials have different rates of thermal expansion. Additionally, the temperature increase in the components of the carrier head is generally not uniform, which can also cause different rates of thermal expansion across the carrier head 100. The base 115 can thermally expand at a higher rate than the retaining structure 120. Because the base 115 and retaining structure 120 are connected, the expansion of the base 115 (shown by arrows 130) can distort (e.g., flex or warp) the retaining structure 120 and/or urge a portion of the retaining structure 120 to lift off from the polishing surface 110, creating a gap 135 between the retaining structure 120 and the polishing surface 110, an exaggeration of which is shown in FIG. 1B. The retaining structure 120 is no longer flat against the polishing surface 110.

A least two deleterious effects can occur as a result of the retaining structure 120 not being flat against the polishing surface 110. First, a non-uniform removal rate across the substrate 105 (i.e., a non-uniform polishing profile) can occur, particularly at the edges of the substrate 105. A non-uniform removal rate can result when the lower surface of the retaining structure 120 is not flat against the polishing surface 110 because of affects on the slurry transport across the substrate 105 and deformation of the polishing surface 110 under the force of the retaining structure 120.

Second, as the carrier head 100 continues to move relative to the polishing surface 110 during the polishing operation, the lower surface of the retaining structure 120 wears down and eventually becomes flat against the polishing surface 110 once again. However, in the interim, multiple substrates 105, for example, one hundred substrates 105, may have been planarized using the carrier head 100. As the retaining structure 120 wears down, the force exerted against polishing surface 110 changes, as does the slurry transfer across the substrate 105. As a result, the removal rate of one substrate to the next is not uniform. These problems are sometimes referred to as "thermal drift" or "process drift". Thermal drift is particularly noted in the first 100 substrates 105 polished after the carrier head 100 has been idle, and therefore has cooled to ambient temperature. Once the retaining structure 120 has worn down such that the structure 120 sits flat against the polishing surface 110, thermal drift may be alleviated.

Figure 2A:
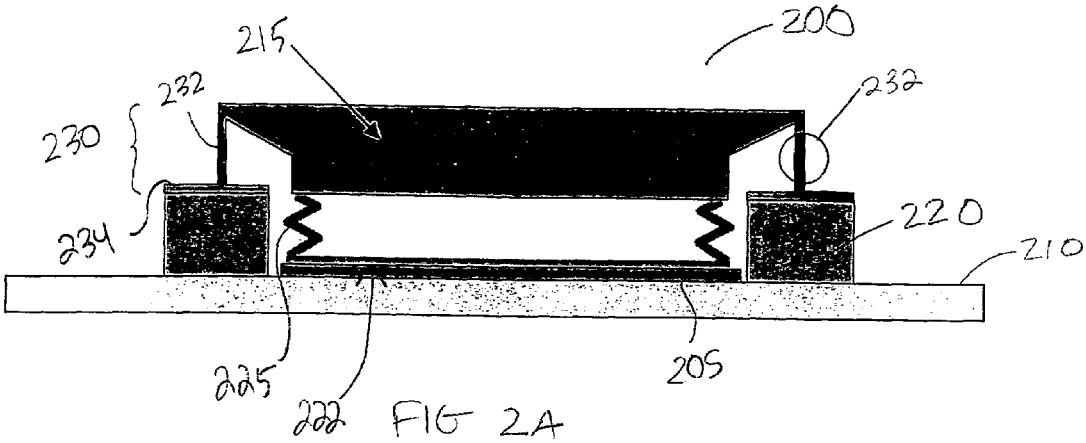
FIG. 2A is a schematic representation of a carrier head including a connector between a base and a retaining structure.

FIG. 2A shows a schematic representation of a carrier head 200 exerting a force on a substrate 205 against a polishing surface 210. The carrier head 200 includes a base 215 and a retaining structure 220. A support structure 225, such as a flexible membrane, is attached to the base 215 and includes a receiving surface 222 for contacting the substrate 205. The retaining structure 220 and the receiving surface 222 define a cavity for receiving the substrate 205, while the retaining structure 220 prevents the substrate 205 from moving along the receiving surface 222. The cavity can be pressurized to urge the substrate against the polishing surface 210.

The carrier head 200 also includes a connector 230 that connects the base 215 to the retaining structure 220. In the embodiment shown, the base 215 has a substantially circular cross-section and the retaining structure 220 is substantially annular. The diameter of the base 215 widens toward the upper surface of the base 215. The connector 230 includes a vertical annular member 232 connected along an upper circumferential edge of the base 215 and attaching to a horizontal annular member 234 connected to an upper surface of the retaining structure 220. The vertical annular member 232 can be connected along the entire upper circumferential edge or at one or more intermittent portions.

The vertical annular member 232 can move relative to the horizontal annular member 234. The configuration of the vertical and horizontal annular members 232, 234 allows for some horizontal movement of the retaining structure 220 relative to the base 215, although not so much movement that the substrate is no longer beneath the receiving surface, while restricting relative vertical movement. In one embodiment, the vertical annular member 232 can be formed from a flexible material, for example, a carbon fiber reinforced plastic such as PPS (polyphenolyne sulfate), that is, rigid enough to not shift around under the forces typically applied during a polishing operation, yet flexible enough to move under the influence of thermal expansion of the base 215.

Figure 2B:
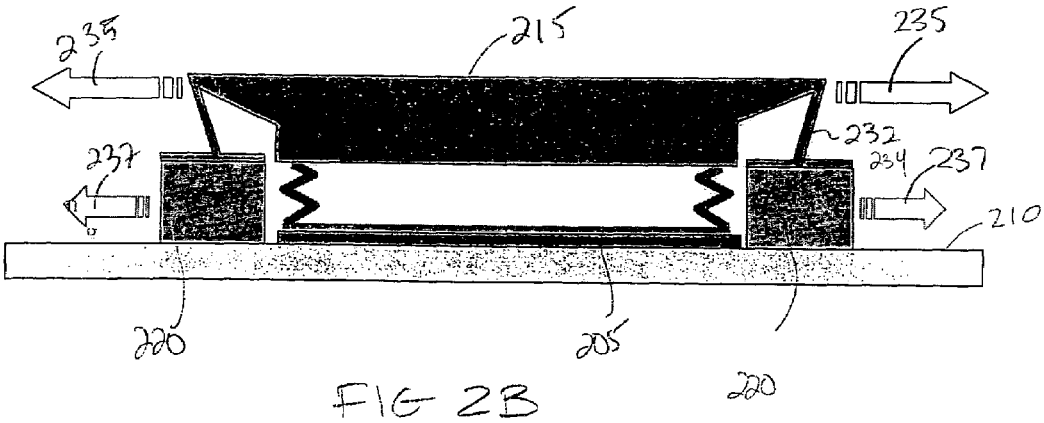
FIG. 2B is a schematic representation of the carrier head of FIG. 2A having undergone thermal expansion.

Movement of the vertical annular member 232 allows the base 215 to thermally expand without influencing the retaining structure 220. FIG. 2B shows the base 215 thermally expanded in the direction of the arrows 235. The vertical annular member 232 is displaced from a substantially vertical position (FIG. 2A) to an angled position (FIG. 2B). The horizontal annular member 234 does not move. The retaining structure 220 can thermally expand in the direction of the arrows 237, independent of the thermal expansion of the base 215. The thermal expansion of the base 215 does not exert a lifting force on the retaining structure 220, as the vertical annular member 232 moves with the thermal expansion of the base 215 without causing the horizontal annular member 234 to move, therefore no lifting force is exerted on the retaining structure 220. The retaining structure 220 can therefore thermally expand laterally, without lifting from the polishing surface 210. By contrast, in a conventional carrier head thermal expansion of the elements creates a lifting force on the retaining structure which causes the retaining structure to lift off of the polishing surface and/or warp.

Including the connector 230 in the carrier head allows the base 215 to thermally expand independent of the retaining structure 220. The base 215 and retaining structure 220 can thermally expand and contract at different rates and not cause distortion to one another. For example, the retaining structure 220 is not urged away from the polishing surface 210 by the thermal expansion of the base 215, and a uniform polishing profile across the substrate 205 can occur. Additionally, in a polishing operation of multiple substrates 205, starting with an idle (i.e., cool) carrier head 215, a uniform removal rate can be applied to the multiple substrates 205.

Figure 2C:
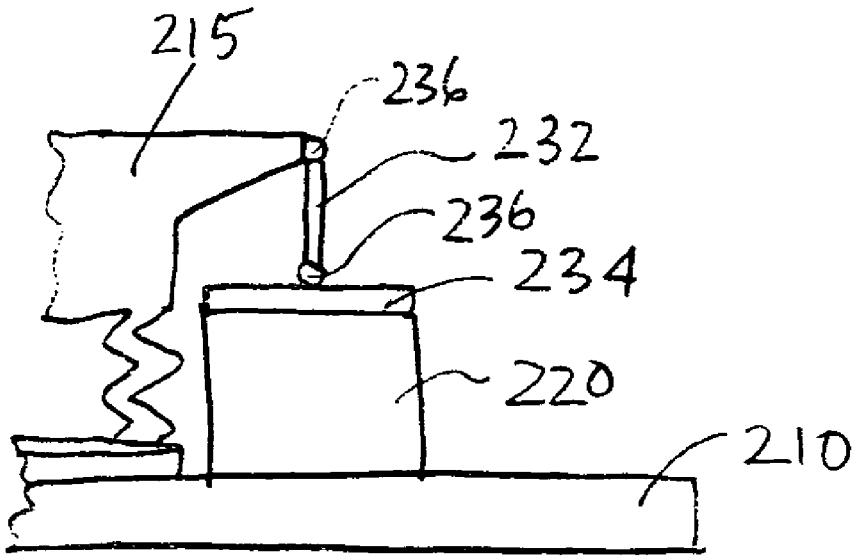
FIG. 2C is a schematic representation of a connector between a base and a retaining structure.
Figure 2D:
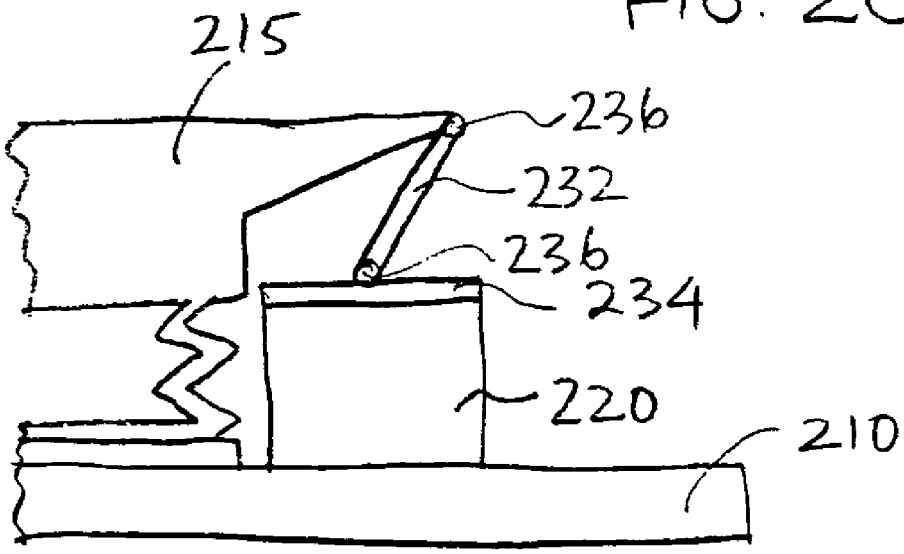
FIG. 2D is a schematic representation of the connector of FIG. 2C after the base has undergone thermal expansion.

Referring to FIGS. 2C and 2D, in another embodiment, the vertical annular member 232 can be a rigid component that is connected to the base 215 and the horizontal annular member 234 by hinged joints 236, such that the vertical annular member 232 can pivot about the hinges 236.

Figure 3A:
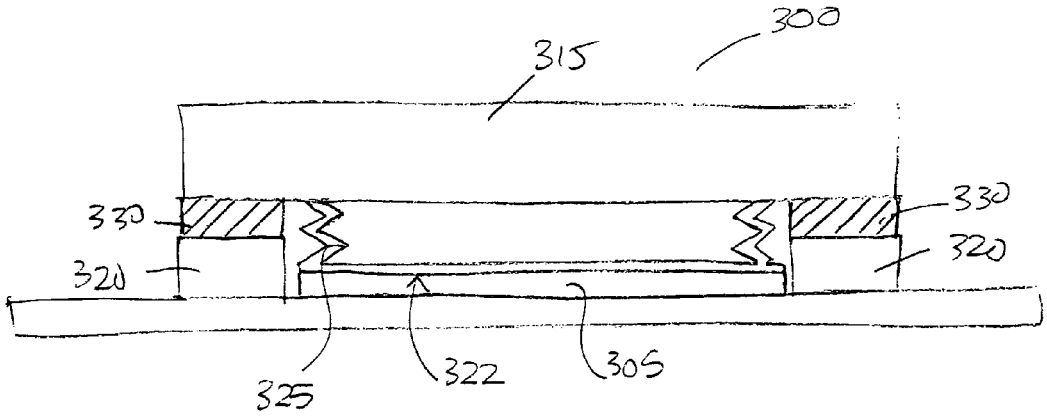
FIG. 3A is a schematic representation of a carrier head including a connector between a base and a retaining structure.
Figure 3B:
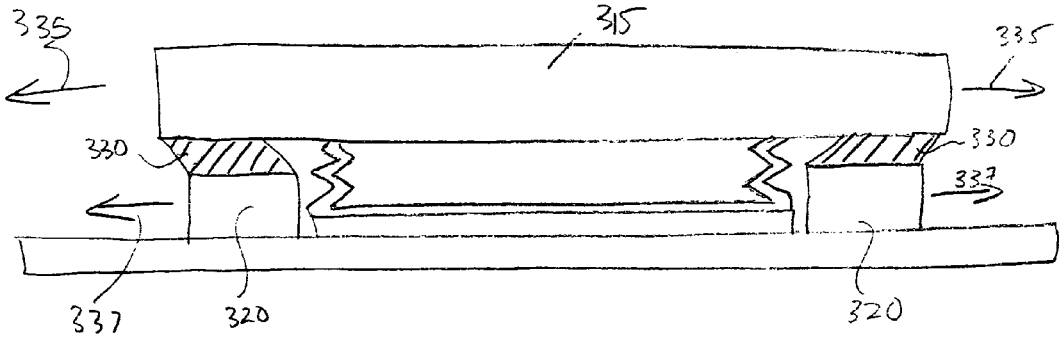
FIG. 3B is a schematic representation of the carrier head of FIG. 3A having undergone thermal expansion.

FIGS. 3A and 3B show another embodiment of a carrier head 300 including a connector 330. The carrier head 300 includes a base 315 and a retaining structure 320. A support structure 325 is attached to the base 315 and includes a receiving surface 322 for contacting a substrate 305. The retaining structure 320 and the receiving surface 322 define a cavity for receiving the substrate 305, while the retaining structure 320 prevents the substrate 305 from moving along the receiving surface 322. The base 315 has a substantially circular cross-section and the retaining structure 320 is substantially annular.

The connector 330 is substantially annular and is attached to the base 315 and the retaining structure 320. The connector 330 can be a single component, or can be two or more separate components attached at discrete spaced apart locations to the base 215 and the retaining structure 320. In this embodiment, the connector 330 is a flexible material and is adhered to a lower surface of the base 315 and an upper surface of the retaining structure 320. As shown in FIG. 3B, when the base 315 thermally expands in the direction of the arrows 335, the connector 330 flexes in the same direction. The force exerted by the thermal expansion of the base 315 is absorbed by the connector 330, and the retaining structure 320 is not influenced by the expansion of the base 315. Similarly, the retaining structure 320 can thermally expand in the direction of the arrows 337 independent of the expansion of the base 315.

The connector 330 can be formed from a flexible material having low structural rigidity, such as a silicone elastomer. The connector 330 can be attached to the base 315 and retaining structure 320 using an adhesive.

Figure 4A:
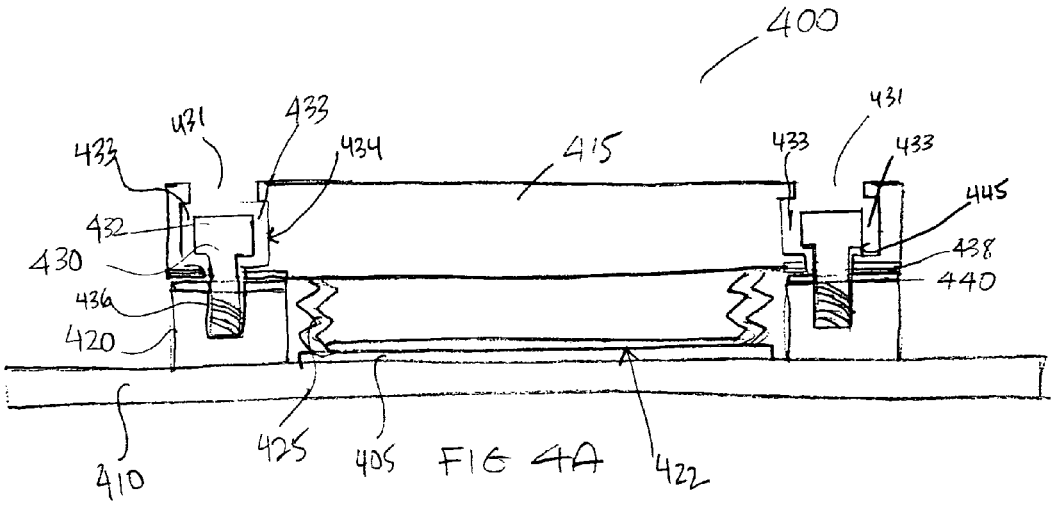
FIG. 4A is a schematic representation of a carrier head including a connector between a base and a retaining structure.
Figure 4B:
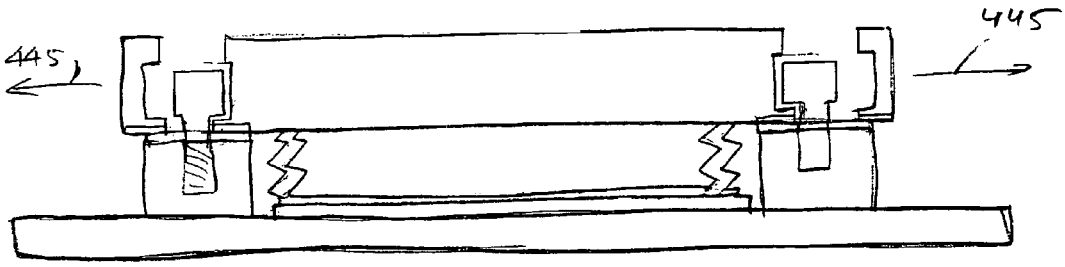
FIG. 4B is a schematic representation of the carrier head of FIG. 4A having undergone thermal expansion.

FIGS. 4A and 4B show yet another embodiment of a carrier head 400 including two or more connectors 430. The carrier head 400 includes a base 415 and a retaining structure 420. A support structure 425 is attached to the base 415 and includes a receiving surface 422 for contacting a substrate 405. The retaining structure 420 and the receiving surface 422 define a cavity for receiving the substrate 405, while the retaining structure 420 prevents the substrate 405 from moving along the receiving surface 422. The base 415 has a substantially circular cross section and the retaining structure 420 is substantially annular.

The two or more connectors 430 each include a rigid member 432 having an upper portion that is housed within a housing 434 of the base 415 and a lower portion that is inserted into an aperture 436 formed within the retaining structure 420. In one embodiment, the rigid member 432 can be a bolt that is threaded into the aperture 436. In another embodiment, the rigid member 432 can be a dowel that is friction fit into the aperture and/or secured into the aperture with an adhesive. The upper portion is accessible via a through hole 431, e.g., to thread the rigid member 432 into the aperture 436.

The rigid member 432 fits loosely into the housing 434 formed in the base 415. That is, some leeway is provided for the base 415 to move relative to the rigid member 432. Optionally, a layer 438 of material can be formed on the lower surface of the base 415 in the region in contact with the retaining structure 420, and/or a layer 440 of material can be formed on the upper surface of the retaining structure 420. The layers 438, 440 can be of a material that facilitates relative movement of the base 415 and the retaining structure 420, such as a layer of Teflon®.

Movement of the rigid member 432 relative to the base 415 can occur if the base 415 thermally expands at a different rate than the retaining structure 420 to which the lower portion of the rigid member 432 is secured. For example, if the retaining structure 420 were to not expand (and therefore not move) at all, and the base 415 did thermally expand in the direction of the arrows 445, then the rigid member 432 also would not move at all, that is, the rigid member 432 moves with the retaining structure 420. The base 415 can move without interference from the rigid member 432 due to the gaps 433 between the rigid member 432 and the housing 434, which permit at least some movement of the base 415 relative to the rigid member 432.

FIG. 4B shows the carrier head 400 with the base 415 thermally expanded relatively more than the retaining structure 420. The rigid member 432, which was approximately centered in the housing 434 in FIG. 4A is now positioned to one side of the housing 434, due to thermal expansion of the base 415. As the base 415 thermally expands at a faster rate than the retaining structure 420, the base 415 slides over the upper surface of the retaining structure 420, which sliding motion can be facilitated with the use of a low friction coefficient layer on either or both of the base 415 and retaining structure 420 (e.g., Teflon®). Because the base 415 is not affixed directly to the retaining structure 420, in that the base 415 can laterally move independent of the retaining structure 420, the retaining structure 420 is not influenced by the thermal expansion of the base 415. The retaining structure 420 is not subjected to a force urging the retaining structure 420 away from the polishing surface 410. A uniform polishing profile across the substrate 405 can therefore be achieved, as well as a uniform removal rate with respect to multiple substrates 405 polished during a polishing operation.

The rigid member 432 contacts the housing 434 at an interface 445. To facilitate movement, the areas of the rigid member 432 and housing 434 that are in contact at the interface 445 can have layers of material with a low friction coefficient, e.g., Teflon®. Alternatively, a compressive material can be included at the interface 445, either as part of either or both of the rigid member 432 and the housing 434, such that the compressive material provides enough give to permit the desired relative movement between the rigid member 432 and the housing 434.

In the embodiment shown, there are two connectors 430 positioned opposite one another on a diameter of the base 415. In other embodiments, multiple connectors 430 can be included at discrete spaced apart locations about the perimeter of the base 415.

The above embodiments were described, for illustrative purposes, in the context of a base thermally expanding at a faster rate than a retaining structure. However, in some implementations the converse can be true, in that the retaining structure can thermally expand faster than the base, thereby causing the outer edge of the retaining structure to lift from a polishing surface. A carrier head including a connector, such as the connectors described above, can be used to avoid this problem as well.

The above embodiments were described in reference to simplified carrier heads, such as those schematically represented in FIGS. 2–4. A carrier head including a connector to a base and a retaining structure, which allows relative movement between the base and the retaining structure, can be implemented in a more complicated carrier head structure. That is, the base and retaining structure can include a number of components, and be more complicated than the simplified support structures shown in FIGS. 2–4. However, a connector can still be included between the base and the retaining structure that allows relative movement between the base and the retaining structure.

In the embodiments described above, a carrier head included a connector at an interface between a base and a retaining structure that was substantially planar and horizontal. In other embodiments, an interface between a base and a retaining structure can be substantially planar and vertical, can be non-planar, and can be at an angle (i.e., rather than horizontal or vertical). A connector, such as those described above, can be included at any such interfaces. In the embodiments described above, the base was substantially circular and the retaining structure was substantially annular. However, in other embodiments, the base and retaining structures can be different shapes, e.g., oval, rectangular or irregular polygons. The connector can be configured accordingly, so long as a connection is provided between the base and the retaining structure.

In one embodiment, a carrier head can be formed using aluminum for the base and stainless steel for the retaining structure, with a connector formed from a flexible material such as PPS. The retaining structure can include a lower layer of PPS.

A number of embodiments of the invention have been described. Nevertheless, it will be understood that various modifications may be made without departing from the spirit and scope of the invention. Accordingly, other embodiments are within the scope of the following claims.

What is claimed is:

1. A carrier head for chemical mechanical polishing, comprising:

a base;

a support structure attached to the base having a receiving surface for contacting a substrate;

a retaining structure attached to the base to prevent the substrate from moving along the receiving surface; and a connector attached to the base and the retaining structure, the connector allowing relative lateral movement between the base and the retaining structure.

2. The carrier head of claim 1, wherein the connector includes a component adapted to flex in a lateral direction and allow lateral movement between the base and the retaining structure.

3. The carrier head of claim 2, wherein the component is a thin-walled annular component.

4. The carrier head of claim 2, wherein the component is formed from a flexible material.

5. The carrier bead of claim 1, wherein the connector includes a plurality of components adapted to flex in a lateral direction and allow lateral movement between the base and the retaining structure.

6. The carrier head of claim 1, wherein the base has a substantially circular cross-section and the retaining structure is substantially annular and the connector includes:

a thin-walled annular component affixed to the base; and a horizontal annular component affixed to an upper surface of the retaining structure; and wherein the thin-walled annular component is joined to the horizontal annular component and is movable relative to the horizontal annular component.

7. The carrier head of claim 6, wherein the thin-walled annular component is flexible.

8. The carrier head of claim 6, wherein the thin-walled annular component is hingedly affixed to the circumferential edge of the base and to the horizontal annular component.

9. The carrier head of claim 1, wherein the connector includes:

a housing within the base;

two or more rigid members, each rigid member having an upper portion housed in the housing and a lower portion secured in an aperture formed in the retaining structure, where the rigid member is laterally movable within the housing.

10. The carrier head of claim 9, wherein each rigid member is a threaded nut and is secured in the aperture by threading the rigid member into aperture.

11. The carrier head of claim 1, where the retaining structure and the receiving surface define a cavity for receiving the substrate.

12. The carrier head of claim 1, wherein the relative lateral movement can be from at least one of expansion or contraction of one or both of the base and the retaining structure.

13. A chemical mechanical polishing apparatus, comprising:

a polishing pad to polish a substrate; and a carrier head to press the substrate against the polishing pad, the carrier head including:

a base;

a support structure attached to the base having a receiving surface for contacting a substrate;

a retaining structure attached to the base to prevent the substrate from moving along the receiving surface; and a connector attached to the base and the retaining structure, the connector allowing relative lateral movement between the base and the retaining structure.

14. The apparatus of claim 13, wherein the connector of the carrier head includes a component adapted to flex in a lateral direction and allow lateral movement between the base and the retaining structure.

15. The apparatus of claim 14, wherein the component is a thin-walled annular component.

16. The apparatus of claim 14, wherein the component is formed from a flexible material.

17. The apparatus of claim 13, wherein the connector of the carrier head includes a plurality of components adapted to flex in a lateral direction and allow lateral movement between the base and the retaining structure.

18. The apparatus of claim 13, wherein the base of the carrier head has a substantially circular cross-section and the retaining structure is substantially annular and the connector includes:

a thin-walled annular component affixed to the base; and a horizontal annular component affixed to an upper surface of the retaining structure; and wherein the thin-walled annular component is joined to the horizontal annular component and is movable relative to the horizontal annular component.

19. The apparatus of claim 18, wherein the tin-walled annular component is flexible.

20. The apparatus of claim 18, wherein the thin-walled annular component is hingedly affixed to the circumferential edge of the base and to the horizontal annular component.

21. The apparatus of claim 13, wherein the connector of the carrier head includes:

a housing within the base;

two or more rigid members, each rigid member having an upper portion housed in the housing and a lower portion secured in an aperture formed in the retaining structure, where the rigid member is laterally movable within the housing.

22. The apparatus of claim 21, wherein each rigid member is a threaded nut and is secured in the aperture by threading the rigid member into aperture.

23. The apparatus of claim 13, where the retaining structure and the receiving surface of the carrier head define a cavity for receiving the substrate.

24. The apparatus of claim 13, wherein the relative lateral movement can be from at least one of expansion or contraction of one or both of the base and the retaining structure.

25. A carrier head for chemical mechanical polishing, comprising:

a base;

a support structure attached to the base having a receiving surface for contacting a substrate;

a retaining structure attached to the base to prevent the substrate from moving along the receiving surface; and a connector attached to the base and the retaining structure, where the connector is configured to allow the base and the retaining structure to thermally expand at different rates of expansion without causing distortion to one another.

26. The carrier head of claim 25, where the base and the retaining structure can thermally expand at different rates without causing the retaining structure to undergo flexing.

27. The carrier head of claim 25, wherein the connector includes a component adapted to flex in a lateral direction and allow lateral movement between the base and the retaining structure.

28. The carrier head of claim 27, wherein the component is a thin-walled annular component.

29. The carrier head of claim 27, wherein the component is formed from a flexible material.

30. The carrier head of claim 25, wherein the connector includes a plurality of components adapted to flex in a lateral direction and allow lateral movement between the base and the retaining structure.

31. The carrier head of claim 25, wherein the base has a substantially circular cross-section and the retaining structure is substantially annular and the connector includes:

a thin-walled annular component affixed to the base; and a horizontal annular component affixed to an upper surface of the retaining structure; and wherein the thin-walled annular component is joined to the horizontal annular component and is movable relative to the horizontal annular component.

32. The carrier head of claim 31, wherein the thin-walled annular component is flexible.

33. The carrier head of claim 31, wherein the thin-walled annular component is hingedly affixed to the circumferential edge of the base and to the horizontal annular component.

34. The carrier head of claim 25, wherein the connector includes:

a housing within the base;

two or more rigid members, each rigid member having an upper portion housed in the housing and a lower portion secured in an aperture formed in the retaining structure, where the rigid member is laterally movable within the housing.

35. The carrier head of claim 34, wherein each rigid member is a threaded nut and is secured in the aperture by threading the rigid member into aperture.

36. The carrier head of claim 25, where the retaining structure and the receiving surface define a cavity for receiving the substrate.

37. The carrier head of claim 25, wherein the relative lateral movement can be from at least one of expansion or contraction of one or both of the base and the retaining structure.

* * * * *